United States Patent [19]

Hull et al.

[11] Patent Number: 4,622,101

[45] Date of Patent: Nov. 11, 1986

[54] METHOD OF OXYGEN BLEACHING WITH FERRICYANIDE LIGNOCELLULOSIC MATERIAL

[75] Inventors: Michael N. Hull, Bardonia; Vacheslav M. Yasnovsky, Orangeburg, both of N.Y.

[73] Assignee: International Paper Company, New York, N.Y.

[21] Appl. No.: 656,298

[22] Filed: Oct. 1, 1984

[51] Int. Cl.[4] ..... D21C 9/147

[52] U.S. Cl. ..... 162/65; 162/79

[58] Field of Search ..... 162/65, 72, 76, 79, 162/70

[56] References Cited

U.S. PATENT DOCUMENTS

| | | | |
|---|---|---|---|
| 1,780,750 | 11/1930 | Horn | 162/26 |
| 2,214,845 | 9/1940 | Wells | 8/110 |
| 2,477,631 | 8/1949 | Levy et al. | 8/105 |
| 2,828,253 | 3/1958 | Kurz et al. | 204/132 |
| 3,489,742 | 1/1970 | Gerull | 260/212 |
| 3,695,994 | 10/1972 | Worster et al. | 162/65 |
| 3,769,152 | 10/1973 | Samuelson | 162/65 |
| 3,929,559 | 12/1975 | Procter | 162/70 |
| 4,050,981 | 9/1977 | Jamieson et al. | 162/65 |
| 4,141,786 | 2/1979 | Eckert | 162/40 |

FOREIGN PATENT DOCUMENTS

| | | | |
|---|---|---|---|
| 942958 | 11/1963 | United Kingdom . | |
| 596687 | 3/1978 | U.S.S.R. | 162/79 |

OTHER PUBLICATIONS

"A Study of Some of the Variables in Bleaching Pulp in an Electrolytic Cell" by David R. Gustafson in TAPPI, 42, pp. 612 to 616, (1959).

"Chlorine-Free Ways of Electrochemical Bleaching of Pulp", E. I. Chupka, et al. Bumazhnaya Promyshlennost (Paper Industry, USSR), N11, 20-21, 1978.

"Electrochemical Way of Bleaching of Kraft Pulp", S. R. Stromsky, E. I. Chupka, Wood Chemistry, USSR, 1978, N4,11-14.

Landucci, "Influence of Transition Metals in Oxygen Pulping", *TAPPI*, vol. 58, No. 1, Feb. 1975, p. 60.

McCloskey et al, "Catalytic Influence of Iron and Magnesium Ions in Oxygen Bleaching Reactions", *TAPPI*, vol. 58, No. 2, Feb. 1975, p. 56.

*Primary Examiner*—Steve Alvo

*Attorney, Agent, or Firm*—Walt Thomas Zielinski

[57] ABSTRACT

Delignifying bleaching of lignocellulosic materials, particularly wood pulps already partly delignified by conventional alkaline pulping processes by electrochemically generated ferricyanide in the presence of an effective amount of molecular oxygen is disclosed.

Attainment of low kappa numbers employing milder temperature and pressure conditions than are employed in conventional oxygen bleaching is made possible and the process may be substituted for at least a portion of the conventional chlorine based bleaching processes which are current industry standard practice for bleaching kraft pulps.

10 Claims, 1 Drawing Figure

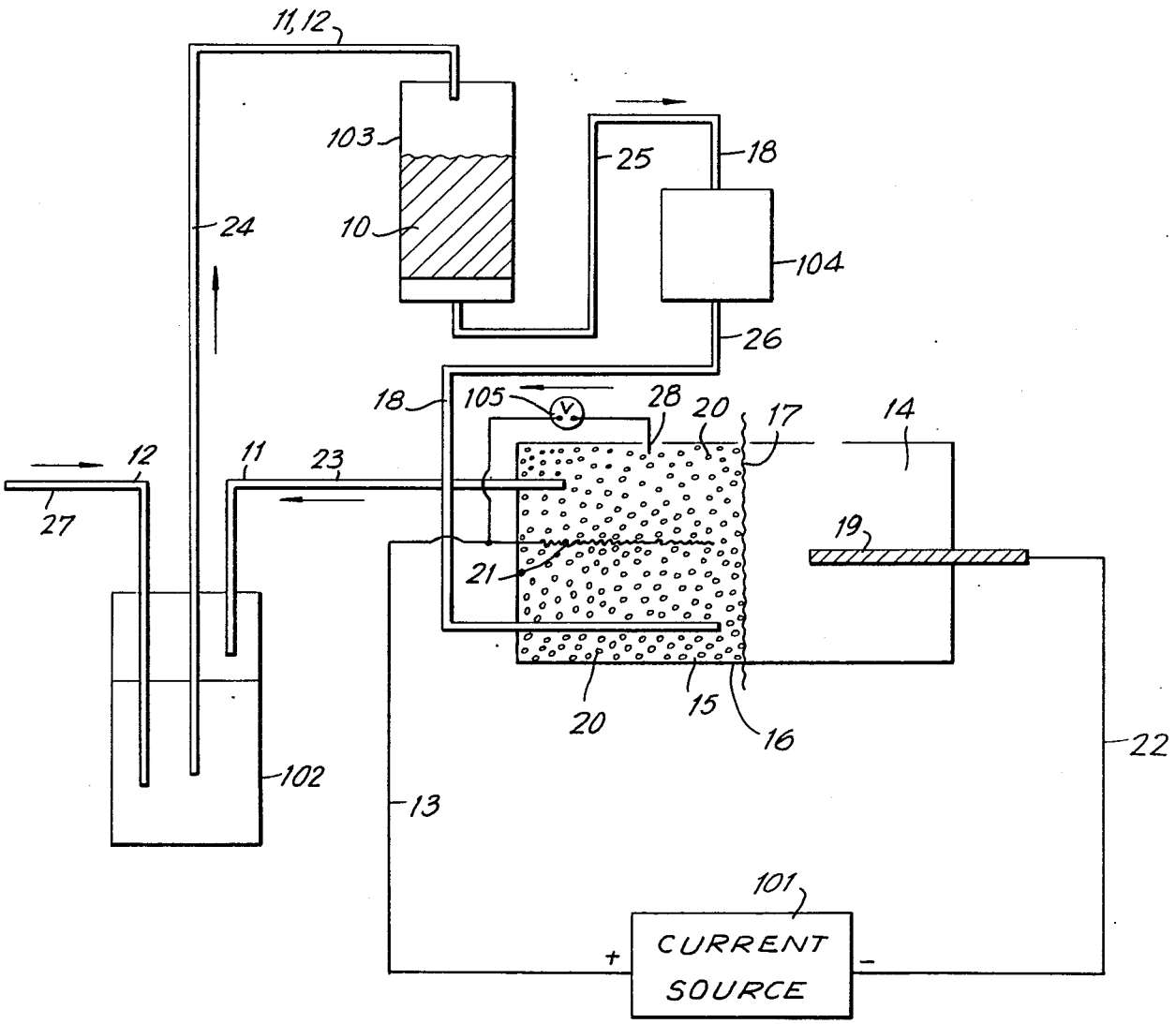
CURRENT SOURCE
101
102
103
104
105
V
10
11
11,12
12
13
14
15
16
17
18
19
20
21
22
23
24
25
26
27
28

METHOD OF OXYGEN BLEACHING WITH FERRICYANIDE LIGNOCELLULOSIC MATERIAL

BACKGROUND OF THE INVENTION

This invention relates to both electrochemical and oxygen bleaching or delignification of lignocellulosic materials particularly wood chips and pulp and more particularly to wood pulp prepared by standard pulping methods, especially alkaline pulping methods, and to products prepared thereby and processes for their use.

Chemical pulp is prepared by treating lignocellulosic material with various "pulping chemicals" to render soluble the major portion of the non-carbohydrate portion of the material. The most common chemical pulp is pulp prepared from wood chips by the "kraft" or sulfate process. In this process the wood chips are treated under heat and pressure with sulfide ions in a strongly alkaline aqueous medium. The resulting pulp, while quite strong, is highly colored probably due to a large number of chromophores in the residual lignin. "White" papers are prepared from such pulps and from other chemical pulps by bleaching which principally comprises further delignification. The usual way this is accomplished is by treatment with chlorine-based chemicals such as chlorine, chlorine dioxide, hypochlorite and other oxidative chemicals which oxidize and solubilize the remaining lignin and, thus, remove the chromophoric material.

Recently other oxidative processes employing materials such as oxygen, ozone, peracids and peroxides have been suggested as alternatives to reduce or replace the need for chlorine based chemicals in the bleaching of pulps. For a number of reasons, well known to those in the art, oxygen has proven to be of particular interest and bleaching sequences employing oxygen which are intended to reduce the use of chlorine based chemicals are in commercial operation. However, severe reaction conditions (temperatures greater than 90° and oxygen pressures exceeding 70 psi) are required for standard oxygen-based bleaching sequences as presently practiced.

One convenient means to reduce the severity of oxygen bleaching conditions is to use catalysts which accelerate the reaction between lignin and oxygen. Several such catalysts are known. They are Salcomine (an ethylenediamine-bissalicylaldehyde complex of cobalt), ortho-phenanthroline, and manganese salts. These catalysts are not suitable for practical commercial use because they are relatively expensive due to the fact that they cannot be recovered and regenerated conveniently.

One potential way to generate or regenerate a catalyst for oxygen bleaching is through an electrochemical treatment of the precursor or spent catalyst, respectively.

Electrochemical generation of oxidants or other "electron carriers" in situ or in a closed cycle process in pulp bleaching, and even in some pulping processes for lignocellulosic material, has been experimented with in the past but, as far as is known, with little or no practical success and these processes have never been used commercially.

Electrochemically generated compounds such as hypochlorite, hydrogen peroxide and the like have been shown to react with and solubilize lignin. However, compounds lacking an oxygen function, for example ferricyanide, will react with but not solubilize lignin to any applicable extent unless some oxygen is also present. The prior art has not recognized the importance of the oxygen that was present in providing its reported results and, hence, has not recognized that compounds such as ferricyanide when present in catalytic amounts together with deliberately added quantities of oxygen function as catalysts to solubilize lignin at a very rapid rate under reaction conditions substantially milder than those employed in conventional oxygen bleaching of lignocellulosic pulps. Oxygen bleaching may, therefore, be conducted under milder conditions of temperature and pressure than are presently employed in conventional processes.

Citation of Relevant Art

The most relevant art of which applicants are aware are two Russian papers and a Russian Inventor's Certificate. These are S. B. Stromsky, E. I. Chupka, Wood Chemistry, U.S.S.R, 1978, N4, pp 11 to 14, "Electrochemical Way of Bleaching of Kraft Pulp"; E. I. Chupka et al., Bumazhnaya Promyshlennost (Paper Industry, USSR), 1978, N11, pp 20 to 21, "Chlorine-Free Ways of Electrochemical Bleaching of Pulp"; and Inventor's Certificate 596,687 to Chupka et al.

In these documents electrochemical bleaching of kraft pulp by electrogenerated ferricyanide is taught. Chupka et al. specifically teach that the bleaching is due to the use of ferricyanide as an electron carrier and note that the rate of bleaching is somewhat faster than bleaching under comparable conditions where no ferricyanide is present. Under the high voltage conditions employed by Chupka et al. a small amount of oxygen was concurrently produced with the ferricyanide but Chupka did not recognize the necessity of that oxygen in producing his result. Thus, no teaching or suggestion is provided by these authors that supplying an effective amount of oxygen from outside the system would permit extremely rapid bleaching even at voltages where oxygen is not generated concurrently with ferricyanide.

An additional related USSR Inventor's Certificate is number 535,383 to Chupka et al. The subject matter of this certificate is kraft pulp bleached by oxygen generated electrochemically. This reference is strictly concerned with supplying oxygen from the decomposition of water directly to pulp in situ rather than as a gas collected from the atmosphere. Catalysis of the reaction is not discussed.

Applicants are also aware of the following publication and patents:

"A Study of Some of The Variables in Bleaching Pulp in an Electrolytic Cell" by David R. Gustafson in TAPPI, 42, pp 612 to 616, (1959) which discusses bleaching of sulfite pulp with chlorine generated electrolytically in situ. This reference teaches only that chlorine generated in situ by electrolysis of chloride can be substituted for chlorine generated externally and supplied as an aqueous solution. Bleaching with other than chlorine is not suggested.

U.S. Pat. No. 1,780,750 which discusses the use of in situ electrolytically generated chlorine to bleach bagasse pulp.

U.S. Pat. No. 2,214,845 which discusses brightening of paper pulp and other materials through the use of ferricyanide to generate ferrous ferricyanide (Turnbull's Blue) thereby removing discoloration provided by the iron originally present and in addition adding "blueing" to the materials in question and reducing any inherent grayness due to other trace foreign substances. Electrochemical generation or regeneration of the ferricyanide and its potential use in delignifying bleaching is not mentioned.

U.S. Pat. No. 2,477,631 which deals with hypochlorite bleaching of paper pulp and other materials with the aid of water soluble salts of cobalt, nickel and manganese. Electrochemical delignifying bleaching and the generation and use of ferricyanide therein are not mentioned.

U.S. Pat. No. 2,828,253 which deals with electrochemical generation of chlorine for the pulping of straw, bagasse and the like.

U.S. Pat. No. 3,489,742 which deals with pulping of sisal and similar fibers using chlorine and alkali generated in situ electrochemically.

U.S. Pat. No. 4,141,786 which deals with the use of manganic ions generated in situ in pulp by treatment of precipitated manganous ions on the pulp with oxygen to delignify lignocellulosic pulps.

British Pat. No. 942,958 which deals with delignifying bleaching of lignocellulosic pulps by alkali and chlorine generated electrolytically in situ.

It is readily apparent that of all the above literature and patents, only the above cited Chupka references are really relevant and these do not teach or suggest applicant's invention.

SUMMARY OF THE INVENTION

The invention provides a process for delignification of lignocellulosic material which comprises treating said lignocellulosic material with a bleaching effective amount of oxygen and a catalytically effective amount of electrochemically generated ferricyanide ion in a substantially aqueous solution at alkaline pH.

The tangible embodiments produced by the process aspect of the invention possess the inherent physical characteristics of being relatively bright pulps when tested by standard brightness methods, and of having equal strength properties to comparable pulps bleached by oxygen under the conditions employed in prior art processes.

The tangible embodiments produced by the process aspect of the invention possess the inherent applied use characteristics, particularly when they are derived from wood pulp, of being suitable for the manufacture of paper and paperboard having strength properties equal to those obtained from prior art oxygen bleaching processes, thus, being useable for all standard uses of lignocellulosic pulp based paper and paperboard.

Special mention is made of embodiments of the invention wherein the lignocellulosic material is wood pulp, of embodiments wherein the wood pulp has been at least partly delignified by a conventional alkaline pulping process and of embodiments wherein the alkaline pH is from about pH 10 to about pH 15, preferably from about pH 13 to about pH 14.5.

DESCRIPTION OF THE DRAWING

The drawing FIGURE is a schematic representation of a preferred apparatus configuration for the practice of the invention.

DESCRIPTION OF THE PREFERRED EMBODIMENTS

The manner of practicing the process of the invention will now be described with reference to the drawing, employing as an illustration a preferred embodiment thereof, namely the bleaching of kraft (alkaline sulfide) softwood pulp 10*a* in a preferred form of apparatus to be described in detail hereinafter. Referring now to the drawing, to practice the process of the invention, the lignocellulosic material 10, conveniently softwood pulp 10*a* prepared by a conventional kraft (alkaline sulfide) pulping process to a lignin content and cellulose degree of polymerization typical of wood pulps prepared by such processes, conveniently to a lignin content, which is represented by a kappa number of about 40 and a cellulose viscosity number of about 30 may be suspended in an alkaline, conveniently about 1N in NaOH, ferricyanide solution 11 containing an amount of ferricyanide ion sufficient to provide a catalytically effective amount of ferricyanide, conveniently about 4 millimolar in $[Fe(CN)_6]^{-4}$, which has been saturated with oxygen gas 12 at normal temperature and pressure, conveniently at about 25° C. and atmospheric pressure. The ferricyanide solution 11 may be obtained by passing a moderate electric current 13, conveniently about 90 m. Ampere, through a ferrocyanide solution of appropriate concentration. The ferricyanide solution 11 will be generated in the anode compartment 15 of an electrochemical cell 16, which may be conveniently separated from the cathode by a semipermeable membrane 17. After saturation with oxygen 12 in standard fashion, the mixture of ferricyanide 11 and oxygen 12 may be continuously circulated though the pulp suspension 10 for a short period of time, conveniently about 3.5 hours, to produce a pulp having a kappa number of about 9 and a viscosity of about 13 cp. The spent solution 18 recovered from the pulp suspension 10 may be recirculated to the anode compartment 15 for reoxidation of ferrocyanide to ferricyanide and subsequent reintroduction of oxygen 12. In the anode compartment 15, in addition to ferricyanide being regenerated, solubilized lignin fragments in the spent solution 18 may be further oxidized. It is thought that this removal of dissolved lignin from the circulating liquor assists in maintaining the extractive power of the liquor for the chromophoric components of the lignocellulosic pulp. The resulting pulp, if desired, may be further bleached by any conventional bleach sequence, or it may be formed directly into paper.

As used herein and in the appended claims the term "a bleaching effective amount of of oxygen" means that the solution is at least saturated with oxygen gas at 25° C. and at normal atmospheric pressure.

The term "a catalytically effective amount of ferricyanide means a concentration of ferricyanide in solution of from about 0.004% to about 0.400% by weight, preferably from about 0.015% at about 0.200% by weight.

The pH of the ferricyanide solution 11 may vary from about 11 to about 15, preferably from about 13 to about 14. The temperature at which the process may be carried out is not particularly critical but conveniently should be less than the 90° to 120° C. at which conventional oxygen bleaching stages are normally carried out. The temperature may range upward from about 0° C. with about 25° to about 65° C. being preferred.

One of skill in the art will understand that the time required for the reaction will also depend upon the type of pulp, and the extent of prior delignification. One of skill in the art will be able to select a desired reaction period to optimize delignification while minimizing cellulose depolymerization employing kappa number and viscosity determinations already standard in the industry.

The concentration of the pulp 10 or other lignocellulosic material in the slurry is also not particularly critical and is largely limited by the difficulty of handling and diffusing reagents through pulp slurries which are too concentrated and the large volume and inordinate residence times involved with too dilute slurries. Normally wood pulp concentrations of from about 1% to about 40%, preferably from about 3% to about 5% and from about 25% to 35% all by weight are preferred because of the ease of handling slurries in these preferred consistency ranges.

The particular configuration of the apparatus employed to practice the invention is not particularly critical and may be any of the prior art described devices. Particularly preferred, however, is a device comprising an electrochemical cell 16 divided by a semipermeable membrane 17, such as a Nafion brand membrane sold by Dupont, into cathodic 14 and anodic 15 compartments employing, conveniently, a carbon electrode 19 in the cathode compartment 14. The anode compartment 15 is conveniently filled with loosely packed nickel shot 20 connected to EMF source 101 by wire 21. Cathode 19 is connected to EMF source 101 by wire 22. Anode compartment 15 is connected to tank 102 by tube 23. Tank 102 is connected to tower 103 by tube 24. Tower 103 is connected to pump 104 by tube 25. Pump 104 is connected to anode compartment 15 by tube 26.

In operation, ferrocyanide solution may be introduced into the system. Passing an electric current 13 from EMF source 101 carried by wires 21 and 22 through electrochemical cell 16 produces ferricyanide solution 11 in anode compartment 15. Ferricyanide solution 11 passes through tube 23 into tank 102 where it is mixed with oxygen 12 introduced, conveniently as air, into tank 102 through tube 27. The mixture of ferricyanide 11 and oxygen 12 passes through tube 24 into tower 103 containing lignocellulosic material 10. After a sufficient residence or dwell time to allow reaction with the lignocellulosic material 10, the now exhausted solution 18 is recirculated through tube 25, pump 104, and tube 26 to anode compartment 15 where it is reoxidized electrically to produce fresh ferricyanide solution 11. Pump 104 provides the hydraulic pressure to produce the fluid circulation of solutions 11 and 18. The electrical potential of nickel anode 20 relative to a standard calomel electrode 28 is measured by voltmeter 105. The flow rate of solutions through the system is adjusted to provide a sufficient dwell time for the reaction to take place in tower 103.

The EMF required for the process of the invention as determined by the potential of the anode with reference to a standard calomel electrode may vary from about +0.2 volts to about +0.6 volts, with about +0.4 volts being preferred. The cell current automatically adjusts to oxidize all species passing through anode compartment 15 which are reactive at the electrical potential selected particularly the ferrocyanide which is completely reactive in this potential range. Thus, the current magnitude is dependent on the concentration of ferrocyanide entering the cell and on the concentration of oxidizable organic species, principally from lignin, extracted from the pulp.

At the anode potentials relative to a standard calomel electrode contemplated by the invention, no oxygen is generated at the anode.

"Kappa" number referred to herein is a measure of residual lignin in a lignocellulosic material and is determined according to TAPPI standard T236 os-76.

Pulp "viscosity" or "viscosity" referred to herein is a measure of the degree of polymerization of cellulose in the pulp. It is determined according to TAPPI standard T230 os-76. Decreasing pulp viscosity reflects an increasing degree of cellulose destruction via depolymerization.

The following examples further illustrate the best mode contemplated by the inventors for the practice of their invention.

EXAMPLE 1

Northern softwood pulp (10 g, kappa 39, viscosity 37) prepared by standard kraft pulping is treated at 25° C. for 3.5 hours by circulating through it 1.5 liters of 1N NaOH solution saturated with oxygen gas and containing ferricyanide ion generated from 1 millimole per liter potassium ferricyanide subjected to a 90 milliAmpere current. At the end of the treatment period, the pulp is separated from the treatment solution, washed and the kappa number and viscosity determined. The kappa number was 9 and the viscosity 13.5.

EXAMPLE 2

The same softwood pulp as in Example 1 is treated with the ferricyanide solution under the conditions described in the Chupka et al references cited above. 21 hours are required to for the pulp reach kappa number 9 and viscosity 13.5.

EXAMPLE 3

Following the method of Example 1 but employing an $N_2$ purge to remove all but traces of oxygen from the system, the same pulp as used in Example 1 requires 19 hours to reach kappa number 11 and viscosity 19 and over 48 hours to reach kappa 9 and viscosity 13.5.

EXAMPLE 4

Northern hardwood pulp (10 g, kappa number 14.0, viscosity 25 cp) prepared by conventional kraft pulping is treated for 3 hours at 50° C. in 1.0 liter of 1N NaOH-$Na_2CO_3$ at pH 12.7 saturated with $N_2$ at 14 psi containing ferricyanide at an excess concentration of 12.3 millimoles/liter. The pulp after separation and washing has a kappa number 10.9 and a viscosity 24.0 cp demonstrating the relatively small degree of delignification (22%) achieved by ferricyanide alone.

EXAMPLE 5

Following analogous treatment conditions but supplying $O_2$ at 14 psi to the pulp in the absence of ferricyanide a kappa number of 12.3 and a viscosity of 21.4 is achieved thus demonstrating the small degree of delignification (12%) obtained by oxygen alone at low temperatures (less than 90° C.) and pressures.

EXAMPLE 6

Following analogous treatment conditions but supplying an oxygen purge at 14 psi to the solution containing ferricyanide, the hardwood pulp of Example 5 reaches a kappa 5.9 (delignification of 58%) at a viscosity of 11.4.

EXAMPLE 7

Following the procedure of Example 5 and supplying an overpressure of oxygen gas at 170 psi to the system the pulp reaches a kappa of 4.6 (delignification of 67%) at a viscosity of 7.8.

The subject matter which applicants regard as their invention is particularly pointed out and distinctly claimed as follows:

1. A process for the delignification of lignocellulosic material which comprises reacting said lignocellulosic material with about 0.004% to about 0.400%, by weight of oven-dried pulp, of electrochemically generated ferricyanide ion in a substantially aqueous solution which is at least saturated with oxygen at normal atmospheric pressure at alkaline pH and at a temperature from about 0° C. to about 65° C.

2. A process as defined in claim 1 wherein the lignocellulosic material is wood pulp.

3. A process as defined in claim 2 wherein the wood pulp has been partly delignified by a conventional alkaline pulping process.

4. A process as defined in claim 1 wherein the ferricyanide ion in the delignification process is generated by electrochemical oxidation of ferrocyanide ion.

5. A process as defined in claim 1 wherein the alkaline pH is from about pH 10 to about pH 15.

6. A process as defined in claim 1 wherein the alkaline pH is from about pH 13 to about pH 14.5.

7. A process as defined in claim 3 wherein the lignocellulosic material is hardwood, softwood or bagasse.

8. A process as defined in claim 1 wherein the lignocellulosic material is hardwood chips, softwood chips or bagasse.

9. A process as defined in claim 1 wherein the ferricyanide ion is generated electrochemically employing an anode contacting the solution in which ferricyanide is generated, said anode being maintained at a potential of +0.2 to +0.6 volts relative to a standard calomel electrode also contacting said solution.

10. A process as defined in claim 9 wherein the anode is maintained at a potential of about +0.4 volts relative to the saturated calomel electrode.

* * * * *